United States Patent [19]

Yamamoto

[11] Patent Number: 4,593,792

[45] Date of Patent: Jun. 10, 1986

[54] APPARATUS FOR CONTROLLING A HYDRAULIC ELEVATOR

[75] Inventor: Tomoichiro Yamamoto, Inazawa, Japan

[73] Assignee: Mitsubishi Denki Kabushiki Kaisha, Tokyo, Japan

[21] Appl. No.: 644,277

[22] Filed: Aug. 27, 1984

[30] Foreign Application Priority Data

Aug. 30, 1983 [JP] Japan ..... 58-158206
Sep. 29, 1983 [JP] Japan ..... 58-181073

[51] Int. Cl.[4] ..... B66B 1/26
[52] U.S. Cl. ..... 187/29 B
[58] Field of Search ..... 187/29; 318/162, 163, 318/481

[56] References Cited

U.S. PATENT DOCUMENTS 2,359,112 9/1944 Hymans ..... 187/29 A
2,565,880 8/1951 Pettengill et al. ..... 187/29 A
4,509,127 4/1985 Yuki et al. ..... 187/29 R X
4,534,452 8/1985 Ogasawara et al. ..... 187/29 A

FOREIGN PATENT DOCUMENTS 55-10512 3/1980 Japan .
57-98477 6/1982 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

An apparatus for controlling a hydraulic elevator in which a bias pattern signal for operating an electric motor at such a low speed that the cage will not move is superposed on a running pattern signal for running the cage, and the electric motor is controlled by the thus superposed pattern signals. Therefore, the amount of oil flowing into or out of the cylinder increases nearly in synchronism with the start of the running pattern, and the cage moves smoothly without generating vibrations.

16 Claims, 14 Drawing Figures

APPARATUS FOR CONTROLLING A HYDRAULIC ELEVATOR

BACKGROUND OF THE INVENTION

The present invention relates to an apparatus for controlling a hydraulic elevator in which a hydraulic pump is driven by a variable-speed electric motor to send pressurized oil to a cylinder, in order to run the cage.

Conventional systems for controlling the hydraulic pressure of a hydraulic elevator can be divided into a system based upon a control valve for controlling the flow rate a system for controlling the pump, and a system for controlling the number of revolutions of an electric motor.

According to the system based upon a control valve to control the flow rate, the electric motor is rotated at a constant speed when the elevator is to be raised while permitting the oil from a hydraulic pump to return to the tank at a predetermined pumping rate. When a start instruction is produced, the flow rate of oil returning into the tank is adjusted by the flow-rate control valve to control the speed of the cage. Further, when the elevator is to be lowered, the descending speed of the cage due to its own weight is adjusted by the flow-rate control valve, in order to control the speed of the cage. According to this system, however, the oil is circulated wastefully when the cage is to be raised, and the potential energy of the cage is consumed for heating the oil when it is to be lowered. Therefore, the energy loss is great, and the temperature of oil raises remarkably.

To compensate for these defects, there has been proposed a system in which the oil is supplied in a required amount only when the elevator is to be raised, and the regenerative braking is applied to the electric motor when the elevator is to be lowered. This system can be divided into the one which controls the pump, and the one which controls the number of revolutions of the electric motor. With the system which controls the pump, use is made of a pump of the variable-capacity-type, and the pumping rate of the pump is adjusted by a control device, resulting, however, in complex construction of the control device and pump, as well as expensive manufacturing cost.

Accompanying the technical progress of semiconductor devices in recent years, on the other hand, there has been proposed a system for controlling the number of revolutions of an induction motor over a wide range by varying the voltage and frequency, as has been disclosed, for instance, in Japanese Patent Laid-Open No. 98477/1982. Based upon this system is a system for controlling the number of revolutions of an electric motor, according to which use is made of a pump of the type having a constant pumping rate, and the pumping rate is controlled by changing the running speed of the electric motor. Therefore, this system can be cheaply manufactured and is highly reliable.

That is, when the elevator is to be raised, the hydraulic pump is driven by the electric motor to feed the pressurized oil into a cylinder. When the elevator is to be lowered, on the other hand, the hydraulic pump is rotated by the pressurized oil to drive the electric motor, thereby to regenerate the electric power.

In practice, however, leakage is inherent in the hydraulic pumps. Due to the leakage, therefore, there exists a range in which the cage does not move even when the hydraulic pump is rotated. That is, as shown in FIG. 1, a start instruction may be produced at a time $t_O$. The hydraulic pump is gradually accelerated and reaches a number of revolution $n_1$ at a time $t_1$. As the number of revolutions becomes greater than $n_1$, the hydraulic pump pumps the oil at a rate greater than the leakage rate, and the cage starts to move. Thus, if the number of revolutions is rapidly increased, the oil is supplied to a pipe between the hydraulic pump and a check valve at a rate greater than the leakage rate. Therefore, a high pressure is generated to rapidly push the check valve open, causing a large starting shock and vibrations to be generated. The cage reaches a constant speed at a time $t_2$, starts to decelerate at a time $t_3$, and comes into halt at a time $t_4$. However, the hydraulic pump continues to rotate, and comes to a halt at a time $t_5$. The starting shock stems chiefly from a sudden increase in the number of revolutions of the hydraulic pump. Therefore, if the number of revolutions is mildly increased as shown in FIG. 2, the cage starts to move at a time $t_{11}$, reaches a constant speed at a time $t_{12}$, starts to decelerate at a time $t_{13}$, and stops at a time $t_{14}$. Thereafter, the hydraulic pump stops at a time $t_{15}$. Accordingly, the number of revolutions is mildly increased as mentioned above, the shock can be reduced. However, the delay in the start mode of operation increases giving the passengers a sluggish feeling. Further, the operation time is lengthened, whereby the transport efficiency is decreased.

The descending mode of operation of the hydraulic elevator is further described below with reference to FIG. 3. Production of a start instruction at a time $t_O$ causes the check valve to open. Therefore, the pressurized oil is allowed to flow suddenly into space between the check valve and the hydraulic pump. As this space is filled with the oil, the hydraulic pump interrupts the flow of pressurized oil, and the flow of oil decreases rapidly from the clinder. Therefore, at the start of the descent operation, the cage descends rapidly but is stopped immediately thereafter to vibrate the cage as shown in FIG. 3(*c*). The cage increases its speed accompnaying the increase in the number of revolutions of the hydraulic pump, while being vibrated, and reaches a constant speed. When a deceleration instruction is issued at a time $t_1$, the hydraulic pump decelerates. Accompanying the deceleration, the cage also decelerates, and assumes a small constant speed. When a stop instruction is issued at a time $t_2$, the hydraulic pump stops at a time $t_3$. The cage continues to descend at a very small speed corresponding to the leakage amount of the hydraulic pump, and comes to a halt while being vibrated when the check valve is closed at a time $t_4$.

As described above, the hydraulic elevator generates large vibration when it starts and stops, whereby the comfort of passengers is reduced.

SUMMARY OF THE INVENTION

The present invention was accomplished in view of the above-mentioned inconvenience, and has for its object to provide an apparatus for controlling an elevator which smoothly starts a cage without generating vibrations by superposing a bias pattern signal that operates the electric motor at such a low speed that will not move the cage on a running pattern signal that runs the cage, and controlling the electric motor with the thus superposed pattern signals, so that the flow rate of oil into or out of the cylinder increases nearly in synchronism with the start of the running pattern.

Another object of the present invention is to provide a hydraulic elevator which offers a comfortable ride without generating vibrations by connecting a hydraulic pump, via a switching valve that opens and closes the pipe, to a cylinder that contains a plunger to raise and lower the cage, and by opening or closing the switching valve under the condition where the hydraulic pump is rotated at a low speed to compensate oil in an amount that corresponds to the leakage amount when the cage is started or stopped.

BRIEF DESCRIPTION OF THE DRAWINGS

FIGS. 4 to 7 illustrate an embodiment of the present invention, wherein

FIG. 4 is a diagram showing the whole construction;

FIG. 5 is a diagram illustrating the major portions in detail;

FIG. 6 is a diagram which illustrates the ascending operation;

FIG. 7 is a diagram which illustrates the descending operation;

DESCRIPTION OF THE PREFERRED EMBODIMENTS

Figure 1:
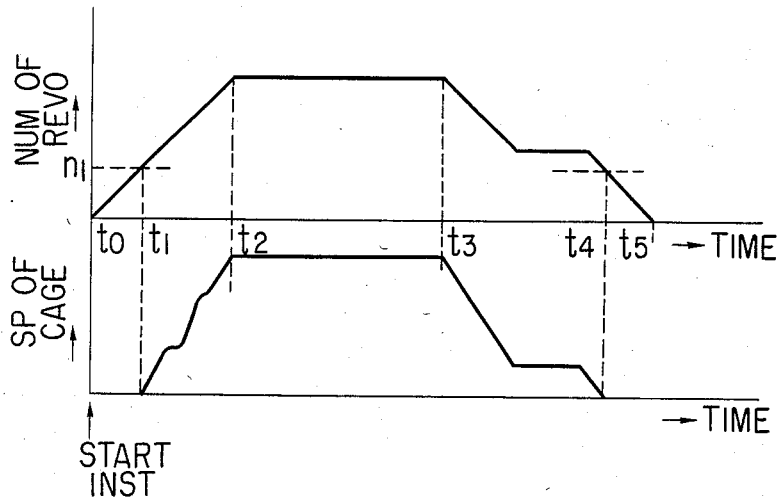
FIG. 1 PRIOR ART
FIGS. 1 and 2 are diagrams illustrating the operation of conventional apparatus for controlling a hydraulic elevator.
Figure 2:
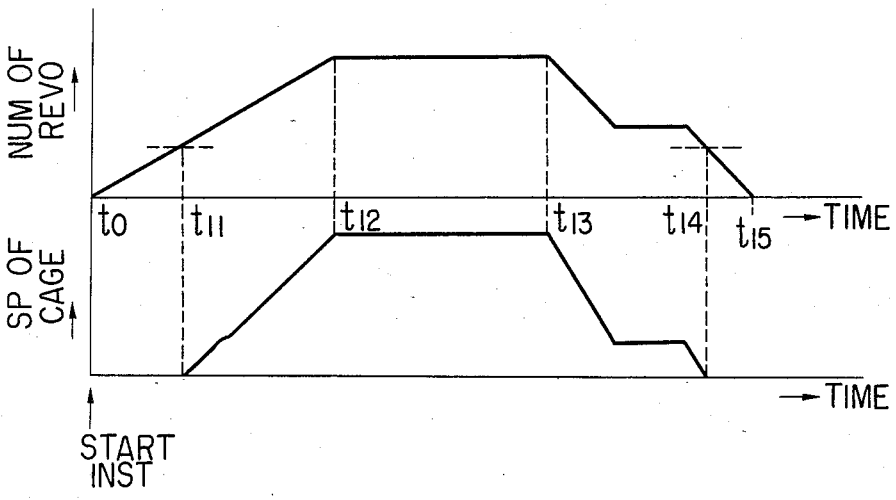
FIG. 2 PRIOR ART
Figure 3:
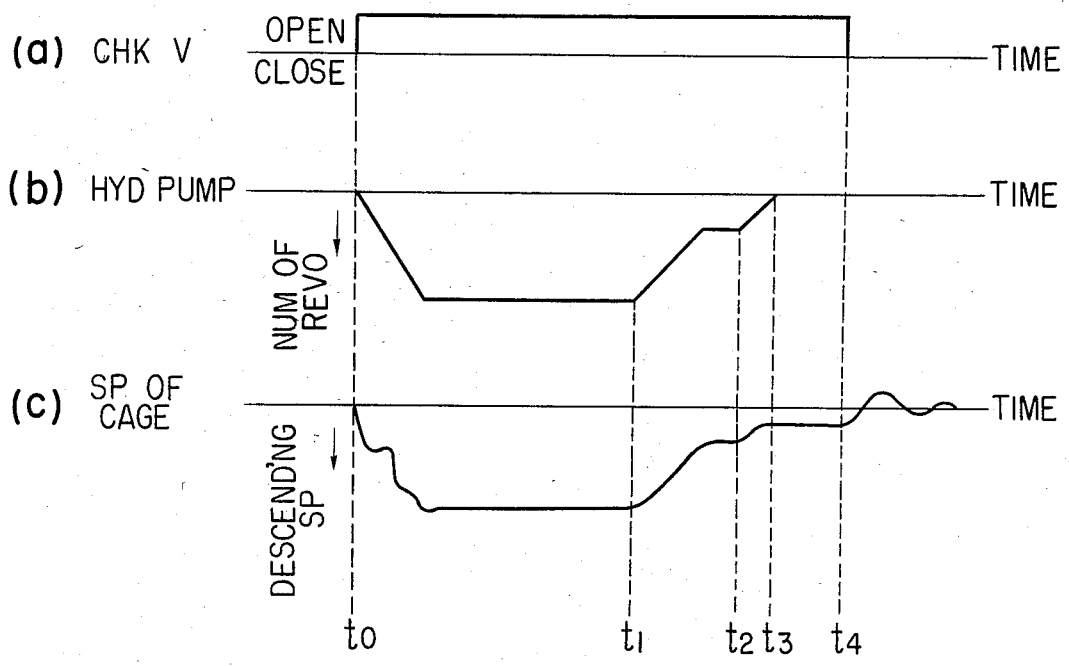
FIG. 3 PRIOR ART
FIG. 3 is a diagram which particularly illustrates the descending operation of a conventional hydraulic elevator.

An embodiment of the invention is shown in FIGS. 4 to 7, wherein reference numeral 1 denotes an elevator path, 2 denotes a cylinder buried in a pit of the elevator path 1, 3 denotes pressurized oil filled in the cylinder, 4 denotes a plunger supported by the pressurized oil, 5 denotes a cage placed on the top portion of the plunger 4, 5*a* denotes a cage floor, 6 denotes a load detector installed under the cage floor 5*a*, 7 denotes a platform floor, 8 denotes a cam mounted on the cage 5, 9 denotes a deceleration instruction switch for decelerating the cage 5 when it is moving, 10 denotes a stop instruction switch for stopping the cage 5, 11 denotes an electromagnetic switching vlave which usually works as a check valve, and which, when the electromagnetic coil 11*b* is energized, is switched to permit the flow in the reverse direction, 11*a* denotes a pipe which is connected between the cylinder 2 and the electromagnetic switching valve 11, and which feeds the pressurized oil, 12 denotes a hydraulic pump which rotates reversibly and which sends and receives the pressurized oil with respect to the electromagnetic switching valve 11 via a pipe 12*a*, 13 denotes a three-phase induction motor for driving the hydraulic pump 12, 14 denotes a speed generator which detects the number of revolutions of the three-phase induction motor 13, 15 denotes an oil tank which supplies and stores the pressurized oil with respect to the hydraulic pump 12 via a pipe 15*a*, 16 denotes an oil temperature detector which detects the temperature of the oil in the oil tank 15, symbols R, S and T denote a three-phase A-C power source, 21 denotes a rectifier circuit which converts the three-phase alternating current into a direct current, 22 denotes a capacitor for smoothing the direct current, 23 denotes an inverter which generates a three-phase alternating current of variable voltage and variable frequency, 24 denotes a regenerating inverter which converts the direct current back to the three-phase A-C power source R, S, T, reference numeral 25 denotes a speed controller which receives a load signal 6*a* from the load detector 6, a speed signal 14*a* from the speed generator 14, an oil temperature signal 16*a* from the oil temperature detector 16, a deceleration instruction signal 9*a*, a stop instruction signal 10*a*, and an operation signal 30*da* generated by a normally-open contact 30*d* that is closed from the time that the start instruction is issued to the time the stop instruction is issued. The speed controller 25 produces a signal 25*a* to control the inverter 23.

Since the bias pattern signal is corrected depending upon the load put on the cage and the oil temperature, the speed of the cage can be maintained constant irrespective of the change of the load and temperature. Therefore, it is made possible to reduce the time in which the cage runs at a low speed and to increase the accuracy of the car arriving at the floor.

Reference numerals 30*a* to 30*c* denote normally-open contacts that the normally open, and that are closed from the time that the start instruction is produced to the time that the stop instruction is produced in order to connect the three-phase induction motor 13 to the inverter 23.

Figure 4:
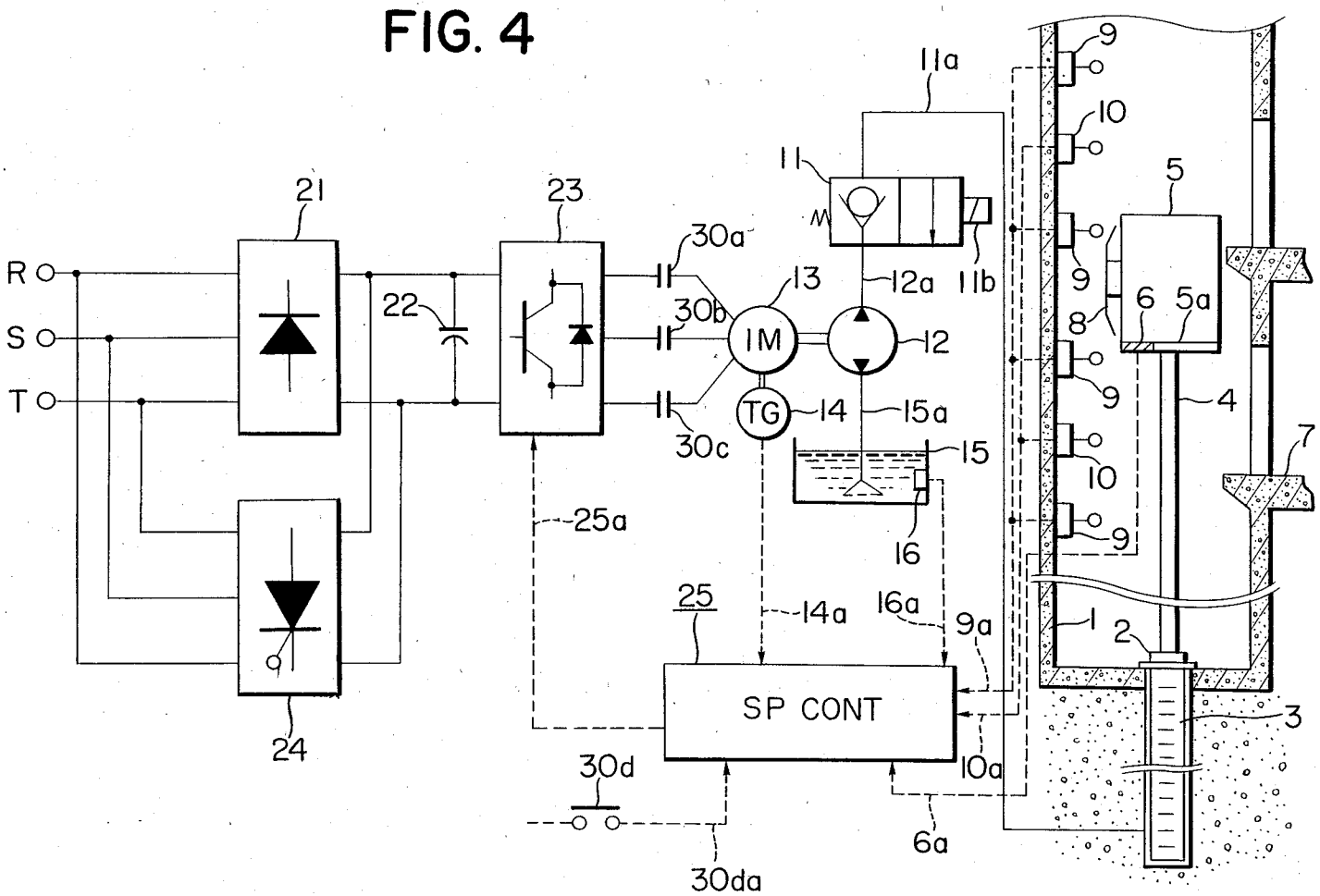
Figure 5:
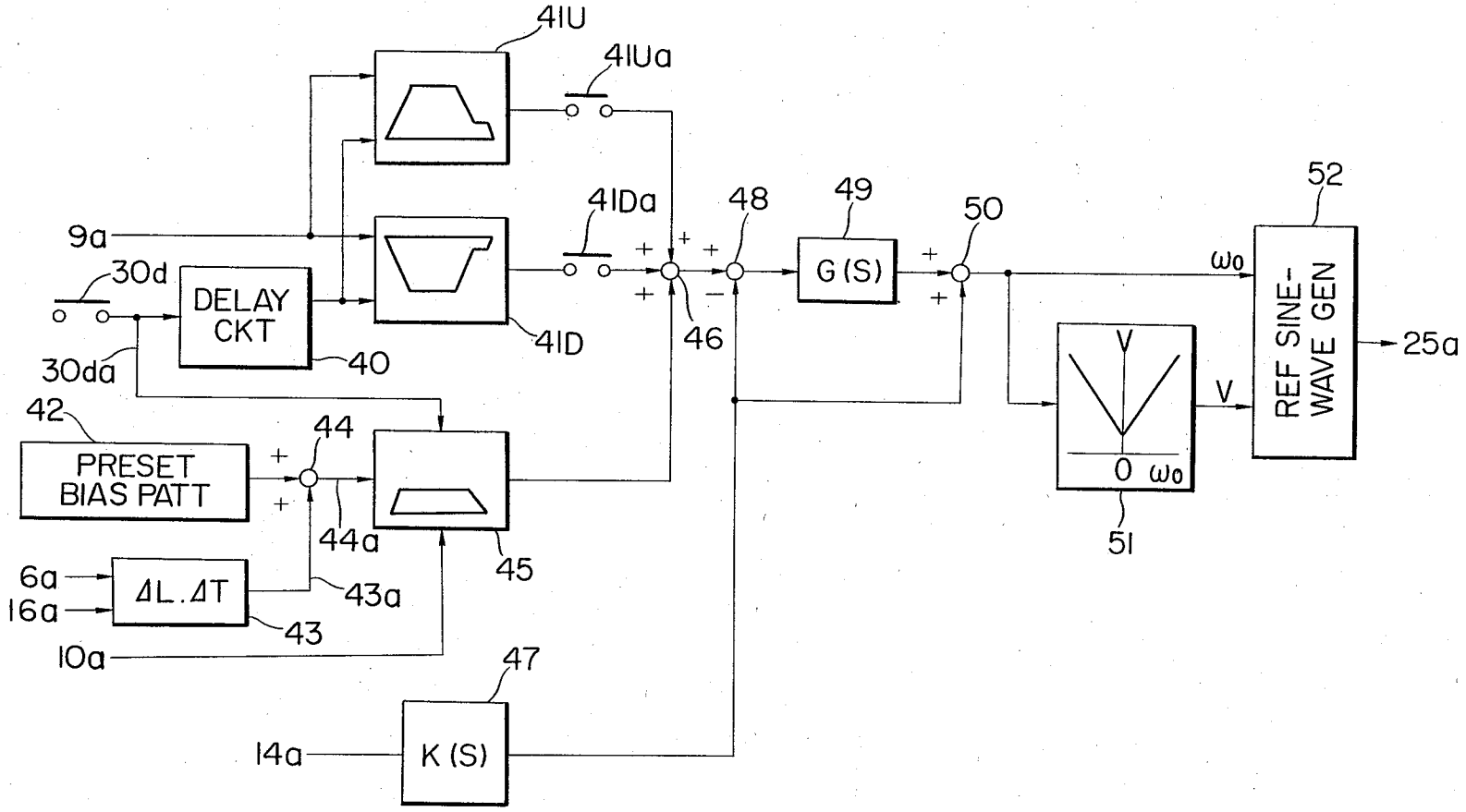
Figure 6:
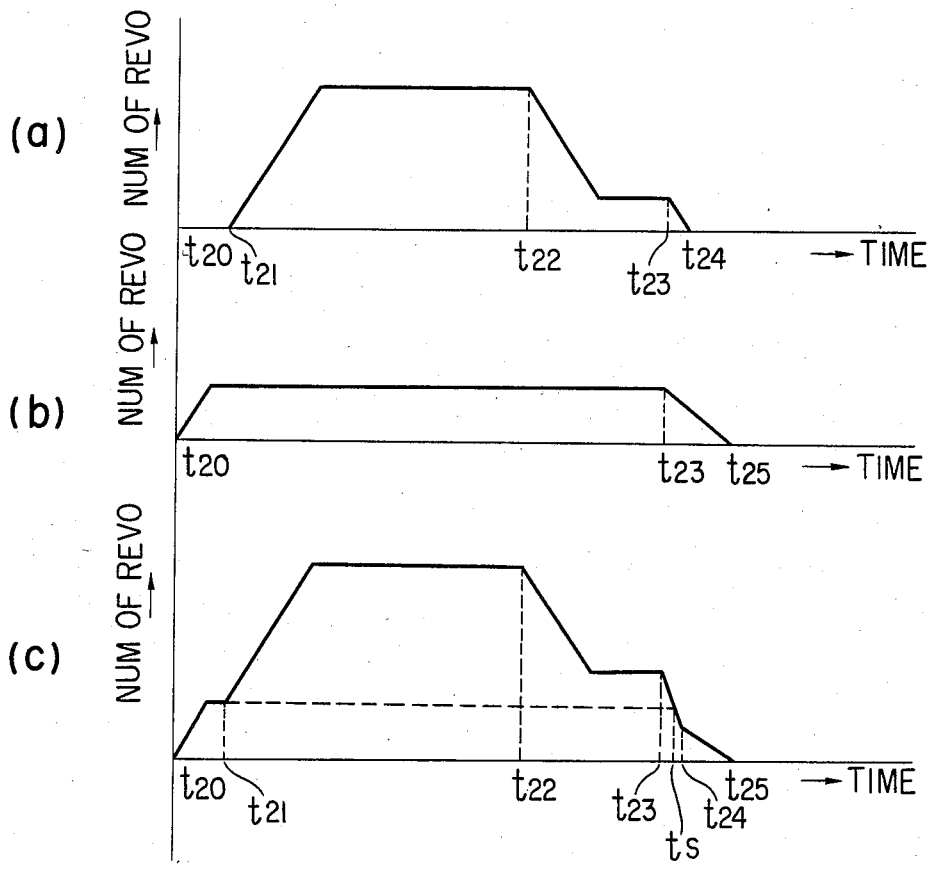
Figure 7:
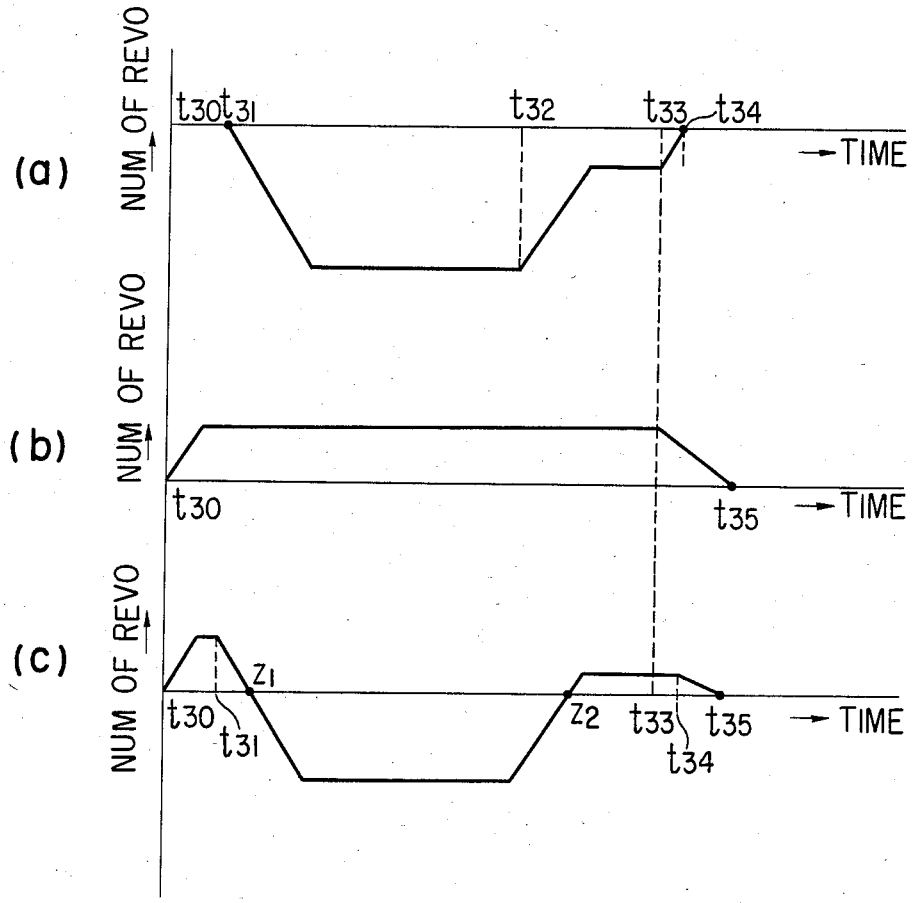

FIG. 5 shows in detail the speed controller 25 of FIG. 4, wherein reference numeral 40 denotes a delay circuit which, when the normally-open contact 30*d* is closed at a time $t_{20}$ as shown in FIG. 6(*a*), produces an output at a time $t_{21}$ which is delayed by a predetermined period of time. The delay circuit 40 may be widely known time constant circuit, a delay relay, or the like. Reference numeral 41U denotes an ascending running pattern generator circuit which produces a pattern signal that rises at a time $t_{21}$ as shown in FIG. 6(*a*) responsive to the output of the delay circuit 40, that breaks to assume a low speed when the deceleration instruction signal 9*a* is issued at a time $t_{22}$, and that becomes zero at a time $t_{24}$. Reference numeral 41D denotes a descending running pattern generator circuit which produces a running pattern signal as shown in FIG. 7(*a*). Reference numeral 41U*a* denotes an upward contact that is maintained closed during a period of upward operation, and 41D*a* denotes a downward contact that is maintained closed during a period of downward operation. Reference numeral 42 denotes a preset bias pattern circuit which sets an initial leakage amount depending upon variance in the leakage amount of the pump, load and the oil temperature, and which produces an instruction to rotate the hydraulic pump 12 at a speed corresponding to the leakage amount of the hydraulic pump 12 under the conditions of no load and an oil temperature of 0° C. Reference numeral 43 denotes an arithmetic unit which receives the oil temperature signal 16*a* and load signal 6*a*, and which adds and corrects the output of the preset bias pattern circuit 42 via an adder 44. Numeral 45 denotes a bias pattern generator circuit which, when the normally-open contact 30*d* is closed at a time $t_{20}$ as shown in FIG. 6(*b*), produces an instruction to rotate the hydraulic pump 12 at a speed corresponding to the leakage amount of the hydraulic pump 12 at that moment. When the stop instruction signal 10*a* is produced at a time $t_{23}$, the pattern signal produced by the bias pattern generator circuit 45 becomes zero at a time $t_{25}$.

Reference numeral 46 denotes an adder which adds the outputs of the pattern generator circuit 41U or 41D and the output of the bias pattern generator circuit 45, and which produces a pattern signal shown in FIG. 6(*c*) or FIG. 7(*c*), 47 denotes a converter circuit which converts the level of the speed signal 14*a* to become the same voltage level as that of the pattern signal, 48 denotes s bustractor which subtracts the output of the adder 46 from the output of the converter circuit 47, 49 denotes a transfer circuit which transfers the output of the subtractor 48 at a predetermined degree of amplification, 50 denotes an adder which adds the output of the transfer circuir 49 to the output of the converter circuit 47, and which produces a frequency instruction signal $\omega_O$, 51 denotes a function generator circuit which produces a linear voltage instruction signal V responsive to the frequency instruction signal $\omega_O$ of the adder 50, and 52 denotes a reference sine-wave generator circuit which produces a signal 25*a* responsive to the frequency instruction signal $\omega_O$ and the voltage instruction signal V, such that a three-phase alternating current of a sine wave is produced from the inverter 23.

In the thus constructed apparatus for controlling a hydraulic elevator, the cage which is in a halt mode of operation may now receive a call in the ascending direction. After the door of the cage 5 is closed, therefore, the start instruction is produced and the normally-open contacts 30*a*, 30*b*, 30*c* are closed, so that the three-phase induction motor 13 is connected to the inverter 23. The normally-open contact 30*d* is also closed, and the bias pattern generator circuit 45 generates a bias pattern which is shown in FIG. 6(*b*). Depending upon this bias pattern, the inverter 23 generates a three-phase alternating current of a low voltage and a low frequency. The three-phase induction motor 13 drives the hydraulic pump 12 at a low speed corresponding to the leakage amount of the hydraulic pump 12. Therefore, the cage 5 is not raised by the bias pattern.

At a time $t_{21}$, the delay circuit 40 produces an output, and the ascending pattern generator circuit 41U generates a pattern signal which is shown in FIG. 6(*a*). Therefore, the adder 46 produces a pattern signal shown in FIG. 6(*c*); i.e., after the time $t_{21}$, the hydraulic pump 12 pumps pressurized oil at a rate greater than the leakage rate. The oil is pumped into the cylinder 2 through a path consisting of oil tank 15 - pipe 15*a* - hydraulic pump 12 - pipe 12*a* - electromagnetic switching valve 11 - pipe 11*a* - cylinder 2. The cage 5 is raised by a height that corresponds to the amount of oil. The hydraulic pump 12 is accelerated and reaches a constant speed. When the cage 5 reaches a predetermined position in front of a desired floor at a time $t_{22}$, the cam 8 operates the deceleration instruction switch 9. Owing to this operation, the pattern signal produced by the ascending pattern generator circuit 41U decreases gradually and, then, assumes a constant value. The cage continues to rise at a very low speed. As the cam 8 operates the stop instruction switch 10 at a time $t_{23}$, the running pattern further decreases and becomes zero at a time $t_{24}$. The bias pattern also starts to decrease at the time $t_{23}$ and becomes zero at a time $t_{25}$. As shown in FIG. 6(*c*), therefore, the output of the adder 46 drastically decreases from the time $t_{23}$ to the time $t_{24}$. The cage 5 comes to a halt at a time $t_S$ at which the flow rate of oil produced by the hydraulic pump 12 becomes smaller than the leakage amount thereof.

The descending operation will be described below. When the starting condition is established at a time $t_{30}$, the three-phase induction motor 13 is operated according to a bias pattern shown in FIG. 7(*b*), which is similar to that of the ascending operation, to raise the pressure in the pipe 12*a*. At a time $t_{31}$, the delay circuit 40 produces an output, and the descending pattern generator circuit 41D produces a pattern signal which is shown in FIG. 7(*a*). Therefore, the adder 46 produces a pattern signal shown in FIG. 7(*c*). Further, the electromagnetic switching valve 11 is energized at the time $t_{31}$ to communicate the pipe 12*a* with the pipe 11*a*. The three-phase induction motor 13 is controlled according to a pattern signal of FIG. 7(*c*), and is gradually decelerated from the time $t_{31}$. Accompanying the deceleration, the oil flows from the cylinder 2 into the oil tank 15.

The three-phase induction motor 13 stops at a time $Z_1$, runs reversely, and reaches a constant speed. As the cam 8 operates the deceleration instruction switch 9 at the time $t_{32}$, the three-phase induction motor starts to decelerate and comes to a halt at a time $Z_2$. During the period of time $Z_1$ to time $Z_2$, the three-phase induction motor 13 is driven by the hydraulic pump 12 and operates as an induction generator which returns electric power back to the three-phase A-C power source R, S, T. After the time $Z_2$, the three-phase induction motor runs again in the forward direction. When the stop instruction switch 10 is operated at the time $t_{33}$, the electromagnetic switching valve 11 is closed, flow of the pressurized oil from the cylinder 2 is interrupted, and the cage 5 stops. The running pattern signal also starts to decelerate at the time $t_{33}$, and becomes zero at a time $t_{34}$. Further, the bias pattern signal also starts to decelerate at the time $t_{33}$, and becomes zero at a time $t_{35}$. The adder 46 produces a pattern signal shown in FIG. 7(*c*) which maintains a constant value for a while after the time $t_{33}$, which decreases starting from the time $t_{34}$ and which becomes zero at the time $t_{35}$. The three-phase induction motor 13 is controlled according to this pattern signal, and drives the hydraulic pump 12.

According to the above-mentioned embodiment, the three-phase induction motor is operated at a low speed according to the bias pattern signal prior to starting the cage in order to supply the oil at a rate corresponding to the leakage rate of the hydraulic pump, and a running pattern signal is generated being superposed on the bias pattern signal in order to control the three-phase induction motor according to the superposed pattern signal. Therefore, the amount of oil supplied into the cylinder increases nearly in synchronism with the start of the running pattern. Accordingly, the cage can be smoothly started without generating vibrations. In the ascending operation, furthermore, the speed of the cage increases with the increase in the speed of the three-phase induction motor. Therefore, energy can be saved as compared with the conventional hydraulic elevator in which the oil from the hydraulic pump is returned in whole amounts to the oil tank, and the flow rate of oil into the oil tank is redued to lift the cage. In the descending operation, in particular, the three-phase induction motor is driven by the hydraulic pump to regenerate the the electric power, making it possible to greatly save energy.

The hydraulic pump can be driven not only by the three-phase induction motor but by any counterpart provided its speed can be controlled according to a pattern signal to accomplish the desired object.

Figure 8:
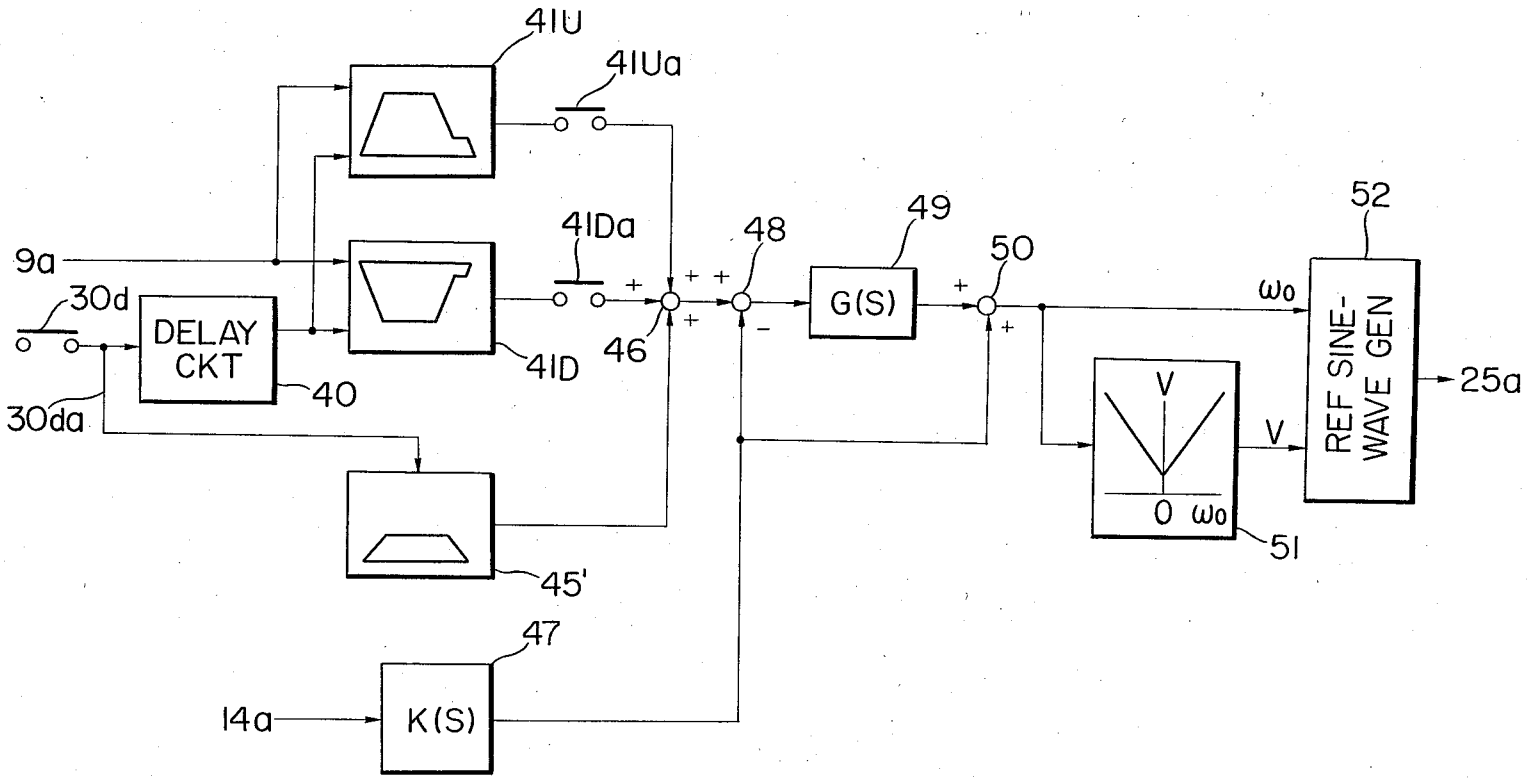
FIG. 8 is an electric circuit diagram showing in detail a speed control apparatus according to a second embodiment.

Another embodiment of the invention will be described below. FIG. 8 shows an example which is modified from the speed controller 25 of FIG. 5. The speed controller of this embodiment does not employ the preset bias pattern generator circuit 42, arithmetic unit 43 or input signal 10*a*, that were employed in FIG. 5. That is, the speed controller of FIG. 8 receives a speed signal 14*a* from the speed generator 14, a deceleration instruction signal 9*a*, and an operation signal 30*da* generated by the normally-open contact 30*d* which is closed from the time that the start instruction is issued to the time that the stop instruction is issued. The speed controller produces a signal 25*a* to control the inverter 23. A bias pattern generator circuit 45' produces an instruction, when the normally-open contact 30*d* is closed, so that the hydraulic pump 12 will rotate at a number of revolutions that corresponds to the leakage amount thereof.

Figure 9:
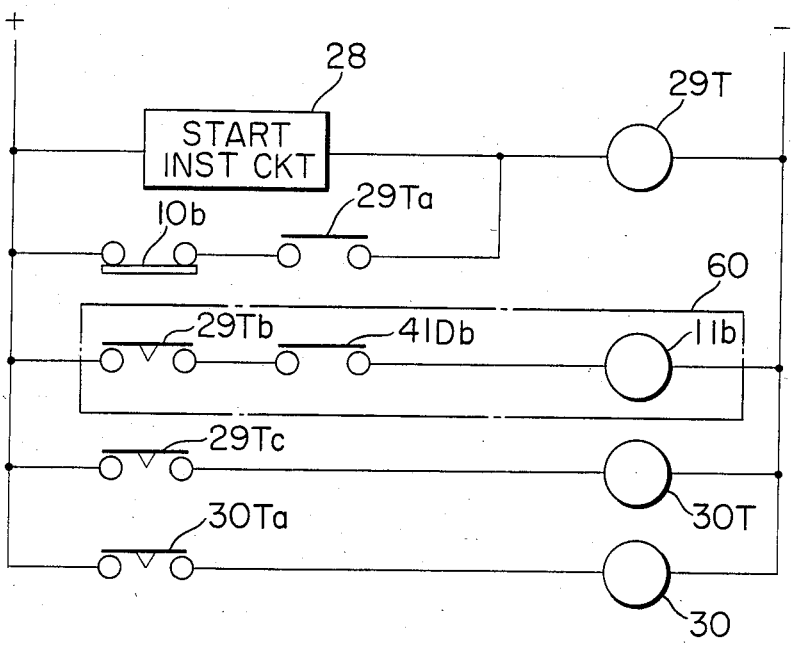
FIG. 9 is a diagram of a control circuit.

FIG. 9 is a connection diagram of a control circuit for effecting the descending operation, wherein symbols (+) and (−) denote a control power source, 28 denotes a start instruction circuit which will be closed responsive to a call signal and a door-closure detect signal, 29T denotes a time-adjusting relay, one end of which is connected to the control power source (+) via the start instruction circuit 28 and the other end of which is connected to the control power source (−), and 29T*a* denotes a normally-closed contact of the time-adjusting relay 29T, the one end thereof being connected to the control power source (+) via a normally-closed contact 10*b* of the stop instruction switch 10, and the other end thereof being connected to one end of the time-adjusting relay 29T. Reference numeral 29T*b* denotes a normally-open contact for restoring the timing of the time-adjusting relay 29T, which controls the electromagnetic coil via the downward contact 49D*b*. Reference numeral 29T*c* denotes a normally-open contact for restoring the timing of the time-adjusting relay 29T, 30T denotes a time-adjusting relay controlled by the normally-open contact 29T*c*, and 30T*a* denotes a normally-open contact for restoring the timing of the time-adjusting relay 30T. Reference numeral 30 denotes an operation contactor which is controlled by the normally-open contact 30T*a*, and which works to open and close the normally-open contacts 30*a*, 30*b*, 30*c* and 30*d* that are shown in FIGS. 4 and 8. Reference numeral 60 denotes a second control means which consists of normally-open contacts 29T*b*, 49D*b* and electromagnetic coil 11*b* that are connected in series, and which works to open and close the electromagnetic switching valve.

The overall structures of the control apparatuses incorporating the control circuits of FIGS. 8 and 9 are as shown in FIG. 4, the two embodiments differing only in the structure of the control circuits.

The control circuit for effecting the ascending operation is the same as that of FIG. 9 with the exception of the contact 41D*b*.

Figure 10:
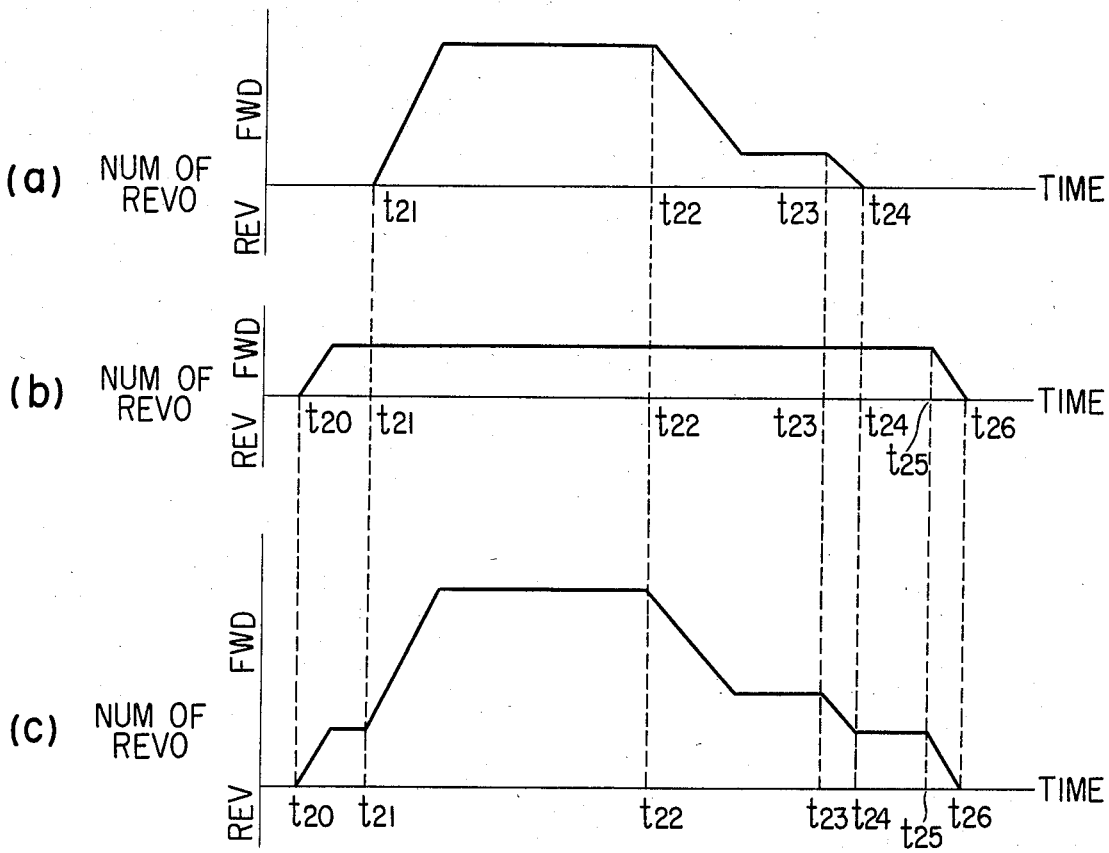
FIGS. 10 and 11 are diagrams for illustrating the operation.

In the thus constructed apparatus for controlling a hydraulic elevator, if a call in the ascending direction is generated while the cage 5 is at rest, the start instruction circuit 28 is closed after the door has been closed, and the time-adjusting relay 29T is energized through a circuit consisting of (+) - (28) - (29T) - (−). As the cage 5 moves from the stop point at a time $t_{21}$ that will be described later, it is held at that position via the normally-closed contacts 29T*a* and 10*b*. As the normally-open contact 29T*c* is closed, furthermore the time-adjusting relay 30T is energized, and the operation contactor 30 is energized by the normally-open contact 30T*a*. The normally-open contacts 30*a* to 30*c* are then closed to connect the three-phase induction motor 13 to the inverter 23, and the normally-open contact 30*d* is also closed so that the bias pattern generator circuit 45 produces a bias pattern starting from the time $t_{20}$ as shown in FIG. 10(*b*). Responsive to the bias pattern, the inverter 23 produces a three-phase alternating current of a low voltage and a low frequency, and the three-phase induction motor 13 drives the hydraulic pump 12 at a low number of revolutions corresponding to the leakage rate thereof. Therefore, the cage 5 is not raised by the bias pattern.

At the time $t_{21}$, the delay circuit 40 produces an output, and the ascending pattern generator circuit 41U produces a pattern signal as shown in FIG. 10(*a*). Therefore, the adder 46 produces a pattern signal which is shown in FIG. 10(*c*), and the hydraulic pump 12 supplies the pressurized oil at a rate greater than the leakage rate thereof. The pressurized oil is supplied to the cylinder 2 via a path consisting of oil tank 15 - pipe 15*a* - hydraulic pump 12 - pipe 12*a* - electromagnetic switching valve 11 - pipe 11*a* - cylinder 2, and the cage 5 is raised by a height corresponding to the amount of the oil. The hydraulic pump 12 is accelerated and reaches a constant speed.

As the cage 5 reaches a predetermined position in front of the desired floor at the time $t_{22}$, the cam 8 operates the deceleration instruction switch 9. Due to this operation, the pattern signal produced by the ascending pattern generator circuit 41U decreases gradually, and then maintains a constant value. The cage 5 continues to rise at a very small speed. The running pattern further decreases as the cam 8 operates the stop instruction switch 10 at the time $t_{23}$, and becomes zero at the time $t_{24}$. The cage 5 therefore comes a halt. The start instruction circuit 28 has been opened by the operation of the deceleration instruction switch 9, and the time-adjusting relay 29T counts the timing as the normally-closed contact 10*b* is opened (the start instruction circuit 28 is opened at a point of starting the deceleration as is widely practiced, and its details are not mentioned here). As the normally-open contact 29T*c* is opened, the time-adjusting relay 30T counts the timing. The normally-open contact 30T*a* is opened at a time $t_{25}$ after a predetermined timing has passed, and the operation relay 30 is de-energized. Therefore, the normally-open contacts 30*a*, 30*b*, 30*c* are opened to de-energize the three-phase induction motor 12, and the normally-open contact 30*d* is opened, so that the bias pattern signal decreases and becomes zero at a time $t_{26}$ as shown in FIG. 10(*b*).

The descending operation will be described hereinbelow.

Figure 11:
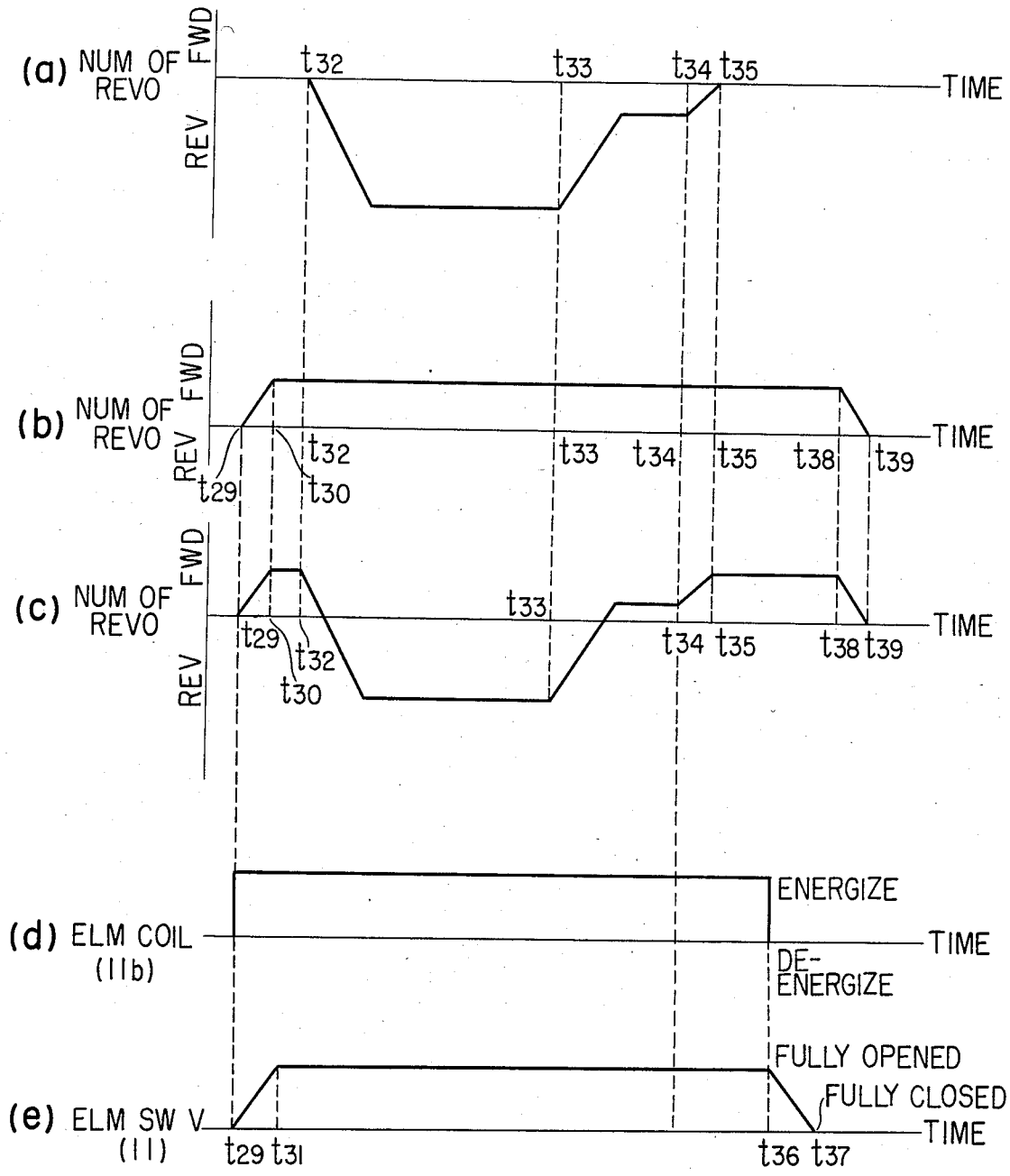

As the starting condition is established, the start instruction circuit 28 is closed to energize the time-adjusting relay 29T, and the electromagnetic coil 11*b* is energized by the closure of the normally-open contact 29T*b* and by the downward contact 41D*b* which is closed. Further, the normally-open contact 29T*c* is closed to energize the time-adjusting relay 30T, and the normally-open contact 30T*a* thereof is closed. Accordingly, the operation contactor 30 is energized. As the normally-open contacts 30*a*, 30*b*, 30*c* are closed at a time $t_{29}$, the three-phase induction motor 13 is energized. Further, the normally-open contact 30*d* is closed so that the bias pattern generator circuit 45 produces a bias pattern that reaches a constant value at $t_{30}$ as shown in FIG. 11(*b*). The electromagnetic switching valve 11 is energized nearly at a time $t_{29}$, and is fully opened at a time $t_{31}$ which is lagged behind th time $t_{30}$. The hydraulic pump 12, however, continues to supply the oil in an amount corresponding to the leakage amount thereof to maintain the pressure in the pipe 12*a* elevated. Therefore, the cage 5 does not descend.

At a time $t_{32}$, the delay circuit 40 produces an output, and the descending pattern generator circuir 41D starts to operate as shown in FIG. 11(*a*). The adder 46 produces a pattern signal as shown in FIG. 11(*c*), and the three-phase induction motor 13 decelerates. As the three-phase induction motor rotates in the reverse direction and reaches a constant speed, the cage 5 descends at a full speed. As the point of deceleration is reached, and the deceleration instruction switch 9 operates at a time $t_{33}$, the pattern signal of the descending pattern generator circuit 41D decreases its output in the reverse direction as shown in FIG. 11(*a*). Accordingly, the output of the adder 46 is converted from the reverse rotation to the forward rotation.

The cage 5 continues to descend at a very low speed due to oil leakage in the hydraulic pump 12. As the stop instruction switch 10 operates at a time $t_{34}$, the pattern signal of the descending pattern generator circuit 41D further decreases and becomes zero at a time $t_{35}$. Accordingly, the adder 46 again produces a pattern signal corresponding to the leakage amount of the hydraulic pump 12, and the cage comes to a halt.

In FIG. 9, the normally-closed contact 10*b* is opened at a time $t_{34}$. Then, after a predetermined period of time has passed, i.e., at a time $t_{36}$, the normally-open contact 29T*b* is opened to de-energize the electromagnetic coil 11*b*. The electromagnetic switching valve 11 is fully closed at a time $t_{37}$ to close the pipe 11*a*. The time-adjusting relay 30T opens the normally-open contact 29T*c* to count the timing, and opens the normally-open contact 30T*a* at a time $t_{38}$. Therefore, the operation contactor 30 is de-energized, and the three-phase induction motor 13 is disconnected from the inverter 23. Further, as the contact 30*d* is opened, the pattern signal of the bias pattern generator circuit 45 starts to decrease from the time $t_{38}$ and becomes zero at a time $t_{39}$.

As described above, the second embodiment deals with a hydraulic elevator in which a plunger is contained in a cylinder filled with a pressurized oil, a reversible hydraulic pump which supplies and drains the pressurized oil is connected to the cylinder to increase or decrease the amount of pressurized oil in order to raise or lower the cage, and, when the cage is at rest, the switching valve is closed to close the pipe between the hydraulic pump and the cylinder. When the cage is to be started or stopped in the descending operation, the switching valve is opened or closed under the condition where the hydraulic pump is rotated at a very slow speed to compensate for the leakage amount thereof. Therefore, vibrations generated at the time of start and stop in the descending operation can be reduced.

Major constituent portions in the speed controller of FIG. 5 will be described herebelow in detail.

Figure 12:
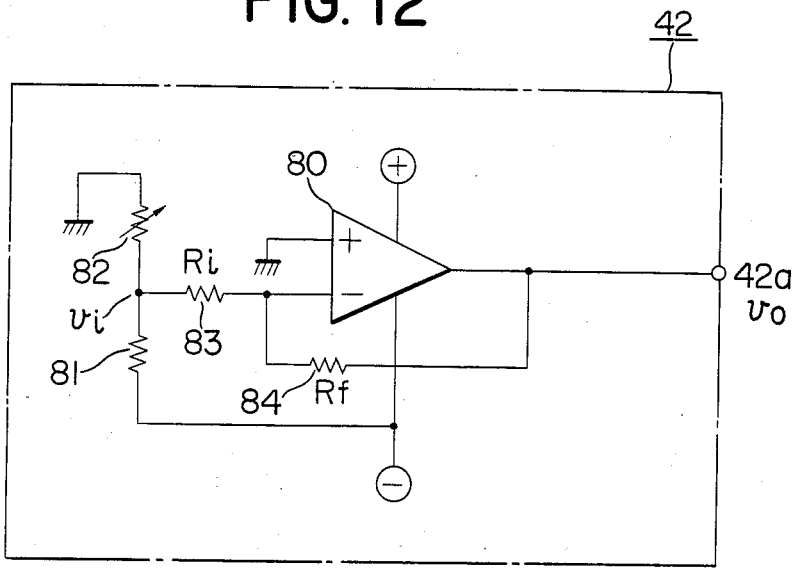
FIG. 12 is a diagram showing a preset bias pattern generator circuit in detail.

FIG. 12 shows a preset bias pattern circuit 42.

The resistance of a variable resistor 82 is varied to obtain a voltage $-v_i$ that is inputed to an operational amplifier 80. If the resistances of other resistors 83, 84 are denoted by $R_i$, $R_f$, the circuit 42 produces an output 42*a* of a voltage $v_O$ that is given by, $$v_O = -\frac{R_f}{R_i} \times (-v_i) = \frac{R_f}{R_i} v_i$$

This voltage $v_O$ just meets a predetermined leakage amount, and is produced at all times.

The voltage $-v_i$ is set by the variable resistor 82 to give an instruction of rotation that meets the leakage amount (leakage coefficient) of the hydraulic pump and that meets the leakage amount of the hydraulic pump under the condition of no load and an oil temperature of 0° C. The voltage $-v_i$ can be adjusted to cope with the changers of leakage amount of the pump as a function of aging.

Figure 13:
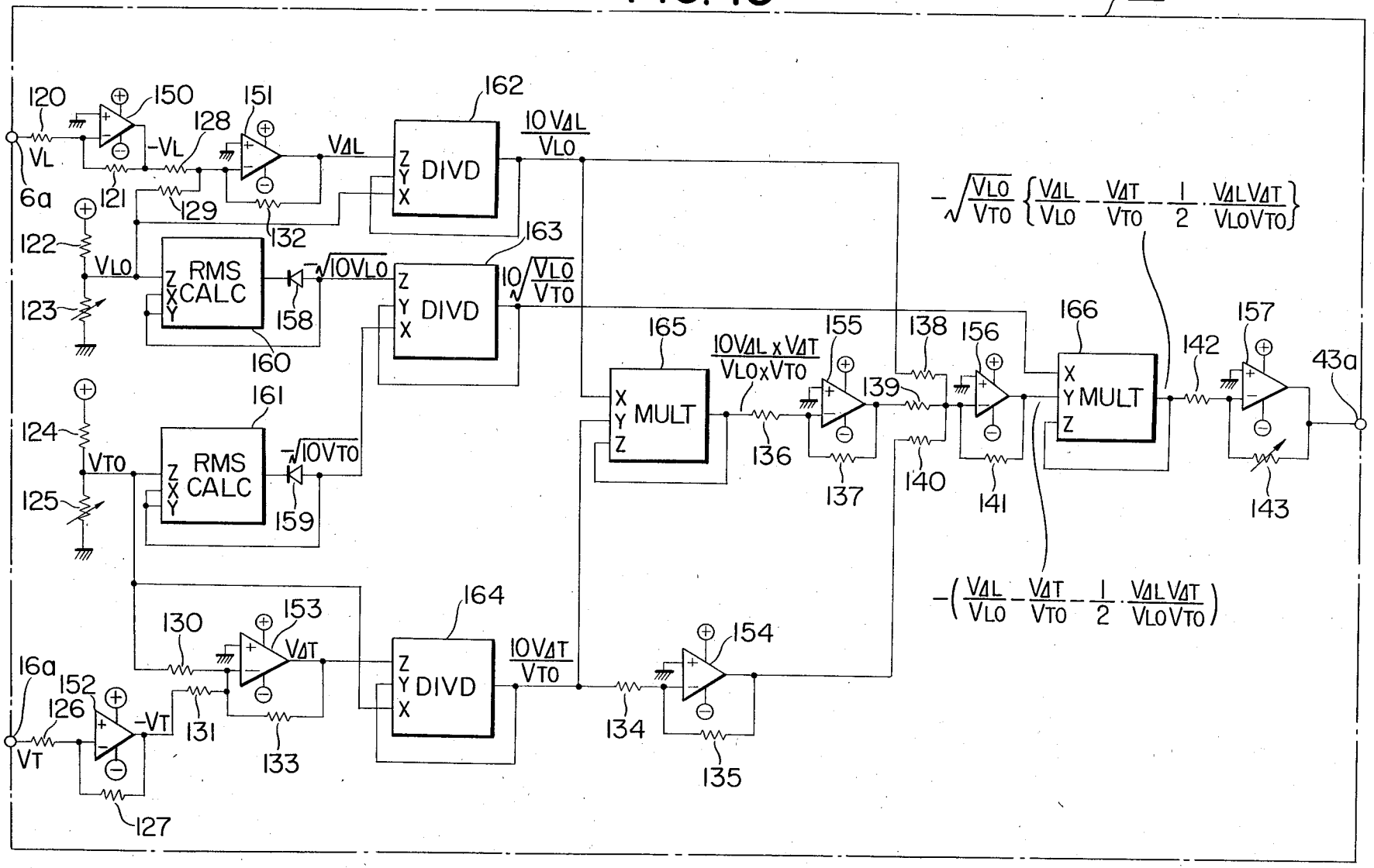
FIG. 13 is a diagram showing in detail an arithmetic unit which corrects the output of the preset bias pattern generator circuit relying upon the oil temperature and the load.

FIG. 13 shows the arithmetic unit 43 for correcting the preset bias pattern depending upon the oil temperature and the load.

In hydraulic elevators, in general, IMO pumps are used. In this case, the leakage amount from the hydraulic pump is given by the following equation, $$Q = K\sqrt{\frac{P}{E}}$$

where

Q denotes the leakage amount from the pump,

P denotes the pressure in the blow-out portion of the pump, and

E denotes an Engler viscosity determined by the temperature of oil.

The cage load signal L varies in portion to the pressure P, and also varies linearly relative to the signal of the load detector 6. Therefore, the cage load signal L varies linearly relative to the pressure in the blow-out portion of the pump. The cage load signal L further varies linearly with respect to the oil temperature and the Engler visclosity.

Therefore, if the load set by the bias pattern generator circuit 42 under the no-load condition, which is converted into a pressure, is denoted by $P_O$, and the Engler viscosity at the oil temperature of 0° C. is denoted by $E_O$, the leakage amount $Q_O$ is given by, $$Q_O = K\sqrt{\frac{P_O}{E_O}}$$

On the other hand, if the load and Engler viscosity, that are converted under given load and oil temperature conditions, are denoted by P and E, the leakage amount Q is given by, $$Q = K\sqrt{\frac{P}{E}}$$

which can be modified as follows:

$$Q = K\sqrt{\frac{P}{E}} = K\sqrt{\frac{P_O + \Delta P}{E_O + \Delta E}} = K\sqrt{\frac{P_O\left(1 + \frac{\Delta P}{P_O}\right)}{E_O\left(1 + \frac{\Delta E}{E_O}\right)}}$$

This can be approximated as, $$Q = K\sqrt{\frac{P_O}{E_O}}\left(1 + \tfrac{1}{2}\cdot\frac{\Delta P}{P_O}\right)\left(1 - \tfrac{1}{2}\cdot\frac{\Delta E}{E_O}\right) \quad (1)$$

Since $Q=Q_O+\Delta Q$, a relation $\Delta Q=Q-Q_O$ holds true. Therefore, $$\Delta Q = K\sqrt{\frac{P_O}{E_O}}\left(1 + \tfrac{1}{2}\cdot\frac{\Delta P}{P_O}\right)\left(1 - \tfrac{1}{2}\cdot\frac{\Delta E}{E_O}\right) - K\sqrt{\frac{P_O}{E_O}}$$

$$= K\sqrt{\frac{P_O}{E_O}}\left[\tfrac{1}{2}\cdot\frac{\Delta P}{P_O} - \tfrac{1}{2}\cdot\frac{\Delta E}{E_O} - \tfrac{1}{4}\cdot\frac{\Delta P \times \Delta E}{P_O \times E_O}\right]$$

If the above equation is converted into the oil temperature and load detection signal, the following equation is obtained, $$\Delta Q = K'\sqrt{\frac{L_O}{T_O}}\left[\frac{\Delta L}{L_O} - \frac{\Delta T}{T_O} - \tfrac{1}{2}\cdot\frac{\Delta L \times \Delta T}{L_O \times T_O}\right] \quad (2)$$

If further converted into a voltage, the following equation is obtained, $$V_{\Delta Q} = K'\sqrt{\frac{V_{LO}}{V_{TO}}}\left[\frac{V_{\Delta L}}{V_{LO}} - \frac{V_{\Delta T}}{V_{TO}} - \tfrac{1}{2}\cdot\frac{V_{\Delta L} \times V_{\Delta T}}{V_{LO} \times V_{TO}}\right] \quad (3)$$

The signal produced from the arithmetic unit 43 has a value that is defined by the above equation.

Although the above description has dealt with the primary approximation only, approximation of higher orders may be pursued if more high precision is required.

In FIG. 13, symbols (+) and (−) denote a power source of a low voltage, reference numerals 120 to 143 denote resistors, wherein 123, 125 and 143 denote variable resistors, reference numerals 150 to 157 denote operational amplifiers, 158 and 159 denote diodes, 160 and 161 denote square root arithmetic units, 162 to 164 denote dividers, and 165 and 166 denote multipliers.

The devices 160 to 166 can be realized by a single integrated circuit, and are constituted according to this embodiment by an INTERSIL ICL 8013 by General Electric Co.

The operation of the circuit will be described below.

A load detection signal has a voltage $V_L$ proportional to the load that receives a signal 6*a*. The resistors 120, 121 and the operational amplifier 150 reverse the polarity of the signal to produce the voltage $-V_L$.

The resistors 122, 123 produce a voltage that corresponds to the output voltage set by the bias pattern generator circuit 42 of FIG. 5 under the no-load condition. The thus divided voltage $V_{LO}$ serves as a reference load detection signal voltage under the no-load condition. The resistors 128, 129, 132 and the operational amplifier 151 produce a difference between the load detection signal $V_L$ and the reference load signal $V_{LO}$, i.e., produce a voltage $V_{\Delta L}(=V_L-V_{LO})$ that corresponds to ΔL. Reference numeral 162 denotes a divider which produces an output voltage $10V_{\Delta L}/V_{LO}$ when an ICL 8013 is used. Reference numerals 158 and 161 denote square root arithmetic units which produce output $-\sqrt{10V_{LO}}$, respectively.

An oil temperature detect signal voltage input through the terminal 16*a* is denoted by $V_T$. This voltage varies in proportion to the Engler viscosity as mentioned earlier. Under the loaded condition, the divider 164 produces an output $10V_{\Delta T}/V_{TO}$, and the diode 159 and square root arithmetic unit 161 produce an output $-\sqrt{10V_{TO}}$. The divider 163 produces an output $10\sqrt{V_{LO}/V_{TO}}$.

The multiplier 165 produces an output $10V_{\Delta L}\cdot V_{66T}/V_{LO}\cdot V_{TO}$.

The resistors 134, 135 and the operational amplifier 154 invert the polarity. The resistors 136, 137 and the operational amplifier 155 invert the polarity. Outputs of these operational amplifiers 154, 155 and output of the divider 162 are sent to an adder which consists of the resistor 141 and the operational amplifier 156 via the resistors 140, 139 and 138. If the resistor 138 has a resistance R, the resistor 139 has a resistance R/2, the resistor 140 has a resistance R, and the resistor 141 has a resistance R/10, the gain of the operational amplifier 156 becomes 1/10. Namely, the output becomes $$-\left(\frac{V_{\Delta L}}{V_{LO}} - \frac{V_{\Delta T}}{V_{TO}} - \tfrac{1}{2}\cdot\frac{V_{\Delta L} \times V_{\Delta T}}{V_{LO} \times V_{TO}}\right).$$

The multiplier 166 produces an output $$-\sqrt{\frac{V_{LO}}{V_{TO}}}\left[\frac{V_{\Delta L}}{V_{LO}} - \frac{V_{\Delta T}}{V_{TO}} - \tfrac{1}{2}\cdot\frac{V_{\Delta L} \times V_{\Delta T}}{V_{LO} \times V_{TO}}\right].$$

The polarity is inverted by the resistors 142, 143 and the operational amplifier 157, the gain is adjusted by the variable resistor 143, and a voltage represented by the equation (3) is produced as a signal 43*a* for correction and is inputed to the adder 44.

Figure 14:
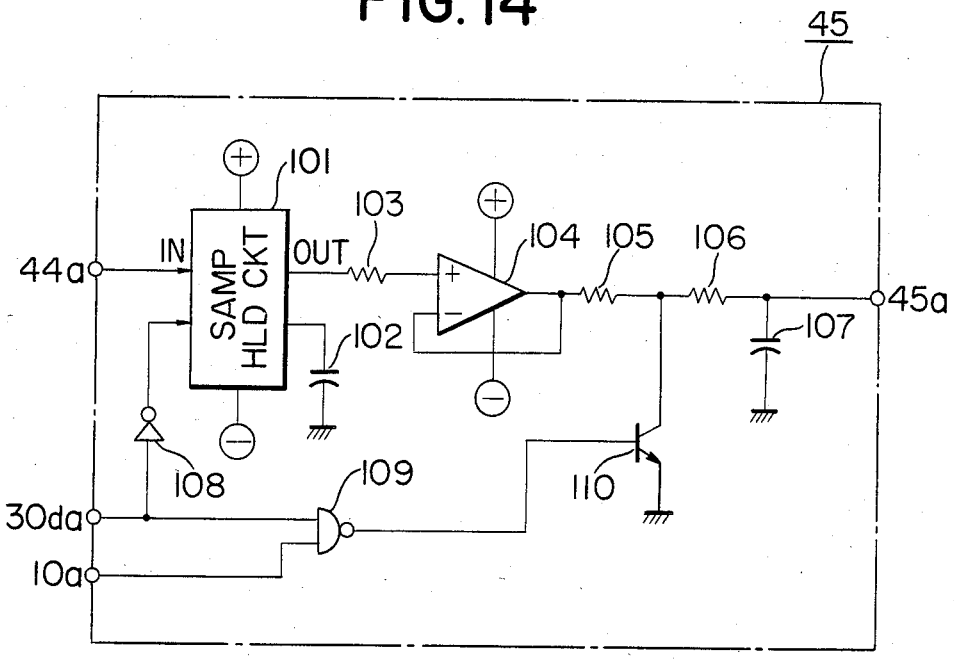
FIG. 14 is a diagram showing a bias pattern generator circuit in detail.

FIG. 14 shows a bias pattern generator circuit, wherein reference numeral 101 denotes a sample holding circuit employing, for example, LM 398 IC, reference numerals 102, 107 denote capacitors, reference numerals 103, 105 and 106 denote resistors, 104 denotes an operational amplifier, 108 denotes a NOT gate, 109 denotes a NAND gate, and 110 denotes a transistor.

The voltage signal 44*a* produced from the adder 44 represents the number of revolutions corresponding to the leakage amount. Further, when the start instruction has not been issued and the cage is at rest, the signal 30*da* assumes the low level, and the NOT gate 108 produces a signal of the high level, so that the sample holding circuit 101 assumes the sampling mode to produce the voltage signal 44*a*. The operational amplifier 104 produces a voltage with its gain maintained at 1. However, since the NAND gate 109 produces a signal of the high level to render the transistor 110 conductive, the output 45*a* of nearly zero volts is produced. Therefore, although the signal 44*a* undergoes variation due to the passengers who go on board or get off the cage while it is halting, the output 45*a* is maintained at zero volts.

When the start instruction is issued to the cage after the door has been closed, the signal 30*da* assumes the high level. At the same time, the signal 10*a* also assumes the high level. The NOT gate 108 produces a signal of the low level, and the input voltage at that moment is held by the capacitor 102. Therefore, even when the load is temporarily varied due to inadvertent manipulation by the passengers on board the cage, a voltage signal is maintained at correct value corresponding to the leakage amount that meets the load and oil temperature of the ordinary condition.

Further, the NAND gate 109 produces a signal of the low level responsive to the signal 30*da* of the high level, the transistor 110 is rendered nonconductive, and the operational amplifier 104 produces the signal 45*a* that rises at a time constant determined by the resistros 105, 106 and capacitor 107 as shown in FIGS. 10(*b*) and 11(*b*). The signal 45*a* then reaches a constant voltage that meets the leakage amount.

When the cage reaches the stop position, the stop instruction signal 10*a* assumes the low level to render the transistor 110 conductive, and the output voltage gradually decreases to reach zero volts being discharged through a path consisting of capacitor 107, resistor 106 and transistor 110. Further, the contact 30*d* is broken since the excitation of a coil is discontinued by the stop instruction signal 10*a*. Therefore, the signal 30*da* assumes the low level being slightly delayed. Accordingly, the output voltage of the bias pattern generator circuit 45 drops to zero.

Responsive to the signal 30*da* of the low level, furthermore, the NOT gate 108 produces a signal of the high level, and the sample holding circuit 101 assumes the sampling mode. However, since the transistor 110 is rendered conductive, the output 45*a* of zero volt is produced, and the condition is the same as before the start instruction is issued.

The bias pattern generator circuit 45' of FIG. 8 produces a preset pattern like the one generated by the aforementioned preset bias pattern circuit 42, depending upon the signal 30*da*.

What is claimed is:

1. In an apparatus for controlling a hydraulic elevator in which an electric motor is controlled depending upon a pattern signal, and a hydraulic pump is driven by the electric motor to run a cage, the improvement comprising:

(a) a bias pattern generator means which generates a bias pattern signal to rotate said electric motor at a low speed within a range in which said cage does not move;

(b) a running pattern generator means which generates a running pattern signal to run said cage;

(c) a signal generator means which, when a start instruction is issued for the cage, sends a signal to said bias pattern generator circuit so that the bias pattern is generated;

(d) a delay signal generator means which sends a signal to said running pattern generator circuit being delayed by a predetermined period of time after said starting instruction has been issued, so that a running pattern is generated; and (e) an adder means which superposes said bias pattern signal and said running pattern signal, and which produces the thus superposed pattern signals to control the electric motor.

2. An apparatus for controlling a hydraulic elevator according to claim 1, wherein, when the cage is to be stopped, said bias pattern generator means produces an output that assumes zero volts after said running pattern has assumed zero volts.

3. An apparatus for controlling a hydraulic elevator according to claim 1, wherein said delay signal generator means receives a signal produced by said signal generator means, and commences the operation to generate a delay signal after having received said signal produced by said signal generator means.

4. An apparatus for controlling a hydraulic elevator according to claim 1, wherein the signal generator means consists of a contactor that is energized from a time when the start instruction is issued to a time when the stop instruction is issued.

5. An apparatus for controlling a hydraulic elevator according to claim 1, wherein the running pattern generator means comprises a pattern generator means for the ascending operation and a pattern generator means for the descending operation, and the bias pattern generator means produces the same bias patterns for both the ascending operation and the descending operation.

6. An apparatus for controlling a hydraulic elevator according to claim 5, wherein the bias pattern generator means produces an instruction such that the hydraulic pump is rotated in a predetermined direction at a number of revolutions corresponding to the leakage amount of the hydraulic pump.

7. An apparatus for controlling a hydraulic elevator according to claim 1, wherein the bias pattern generator means generates a bias pattern according to an instruction produced by a preset bias pattern producing means which produces a preset bias pattern and an instruction produced by correction means which generates a correction signal depending upon the temperature of the operation oil and the load in the cage.

8. An apparatus for controlling a hydraulic elevator according to claim 7, wherein the preset bias pattern producing means produces an instruction to rotate the hydraulic pump at a speed corresponding to the leakage amount of the hydraulic pump under the conditions of no load exerted on the cage and an oil temperature of 0° C.

9. An apparatus for controlling a hydraulic elevator according to claim 7, wherein provision is made of an adder which adds the output produced by the preset bias pattern producing means to the output produced by the correction means, and the output of said adder is input to said bias pattern generator means.

10. An apparatus for controlling a hydraulic elevator according to claim 1, which further comprises:

a cylinder which accommodates a plunger that moves depending upon the amount of oil therein, so that the cage is ascended or descended;

a hydraulic pump which is connected to said cylinder via a pipe, and which rotates in the forward and reverse directions to supply and drain the pressurized oil in order to increase or decrease the amount of pressurized oil in said cylinder;

a switching valve which is provided between the hydraulic pump and said cylinder and which opens or closes said pipe; and control means which opens and closes said switching valve under the condition in which said hydraulic pump is rotated at such a low speed that the oil is suppled at a rate to compensate the leakage rate of said pump.

11. An apparatus for controlling a hydraulic elevator according to claim 10, wherein when the cage is to be stopped, the control means causes said bias pattern generator means to produce an output so that the switching valve is closed under the condition where the hydraulic pump is rotated at a low speed, and the control means causes said bias pattern generator means to discontinue the production of the output after the switching valve has been closed.

12. An apparatus for controlling a hydraulic elevator according to claim 11, wherein the control means comprises a first means which generates a signal to close said switching valve, and a second means which generates an operation-stop signal to said bias pattern generator circuit being delayed by a predetermined period of time behind the signal produced by said first means.

13. An apparatus for controlling a hydraulic elevator according to claim 12, wherein said first means produces a signal after a predetermined period of time has passed from the issue of the stop instruction for the cage.

14. An apparatus for controlling a hydraulic elevator according to claim 12, wherein said first means consists of a time-adjusting relay which has two contacts and which works to adjust the time, one of said two contacts working to open and close said switching valve, and another contact working to operate said second means.

15. An apparatus for controlling a hydraulic elevator according to claim 12, wherein said second means has a time-adjusting relay that initiates the time-adjusting operation upon receipt of a signal from said first means, and wherein a contactor that is energized after the cage has started, is de-energized by said time-adjusting relay after a predetermined period of time has passed.

16. An apparatus for controlling a hydraulic elevator according to claim 10, wherein, when the cage is to be started, said control means causes said bias pattern generator means to produce a bias pattern, so that said switching valve is opened.

* * * * *